US005637004A

United States Patent [19]

Chen et al.

[11] Patent Number: 5,637,004

[45] Date of Patent: Jun. 10, 1997

[54] CONNECTOR WITH LATCH FOR RELEASABLY LOCKING MODULE THEREIN

[75] Inventors: Jeff I. F. Chen, Chung-Li; Yu S. Hsiao, Tu-Chen; Y. H. Kang, Pan-Chiao, all of Taiwan

[73] Assignee: Hon Hai Precision Ind. Co., Ltd., Taiwan

[21] Appl. No.: 416,316

[22] Filed: Apr. 4, 1995

[51] Int. Cl.[6] ..... H01R 13/62

[52] U.S. Cl. ..... 439/157; 439/328

[58] Field of Search ..... 439/157, 152, 439/328

[56] References Cited

U.S. PATENT DOCUMENTS 4,070,081 1/1978 Takahashi ..... 439/157

FOREIGN PATENT DOCUMENTS 000517639 12/1992 European Pat. Off. ..... 439/157
0284772 11/1988 Japan ..... 439/157
0213068 8/1990 Japan ..... 439/157

*Primary Examiner*—Neil Abrams
*Assistant Examiner*—Eugene G. Byrd

[57] ABSTRACT

A header connector (30) includes an insulative housing (32) having a plurality of contacts (42) extending upwardly therethrough. The housing (32) is generally formed by a first pair of opposite side walls (34) and a second pair of opposite end walls (36) to define a space (40) therein for receiving a module (102) and its associated socket connector (100). A pair of cavities (44) are disposed adjacent to two opposite ends of the housing (32) for respectively receiving a pair of corresponding latch/eject members (70) therein wherein each cavity (70) includes a cross-shaped cross-section and extends through in a lateral direction the corresponding surfaces of the housing which define such cavity (44). Thus, the latch/eject member (70) within the cavity (44) is adapted to be in the housing (32) pivotally retained along an axis which extends in the lengthwise direction of the housing (32) whereby such latch/eject member (70) may lock the module (102) when the latch/eject member (70) is in a first (vertical) locking position, and may project out of the corresponding cavity (44) in the lateral direction for release and ejection of the module (102) when the latch/eject member (70) is in a second (angular) open position.

15 Claims, 12 Drawing Sheets

CONNECTOR WITH LATCH FOR RELEASABLY LOCKING MODULE THEREIN

BACKGROUND OF THE INVENTION

1. Field of the Invention

The invention relates to electrical connector assemblies for use with modules, particularly to a header type connector with a pair of latches approximate two opposite ends for therein releasably locking a module board wherein a complementary socket connector which is solderably mounted on the bottom edge portion of such module board, is adapted to be mechanically and electrically engaged within the header connector.

2. The Prior Art

As shown in FIG. 1, a header connector 10 which can be vertically and solderably mounted on a mother PC board (not shown), includes an insulative housing 12 and a plurality of contacts extending upward therein. The housing 12 comprises a pair of opposite side walls 14 and a pair of opposite end walls 16 to define a closed type space 18 for receiving therein a module board 20 and its associated socket connector 22 wherein such socket connector 22 is attached to the bottom edge portion of the module 20. Under this situation, the socket connector 22 is electrically and mechanically engaged with the contacts 13 of the header connector 10, and two side edges of the module 20 are adapted to be received within a pair of corresponding slots 24 formed in the end walls 14 for proper engagement within the header connector 10. It is also seen that there are two opposite semi-circular posts 26 formed on the header connector 10 incorporating a pair of corresponding funnels 28 positioned at two opposite ends of the socket connector 22 for consideration of mutual alignment when the socket connector with the module 20 is inserted into the header connector 10 from the top. Thus, through the header connector 10 and the complementary socket connector 22, the mother board on which the header connector 10 is mounted, and the module 20 can operatively communicate with each other for signal transmission.

Two problems may exist in this operative application. The first is that there is no proper retention means to reliably and efficiently secure such module 20 and socket connector 22 assembly in the header connector, and therefore there is a high possibility for such assembly to be disengaged from the header connector 10 and result in signal loss when a vibration is imposed on the header connector 10 or the module 20 and its associated socket connector 22. The second is that to withdraw the module 20 and its associated socket connector 22, it is common to manually hold the module itself to pull it out from the header connector 10, while the retention forces to resist such withdrawal are naturally exerted between the contacts of the socket connector 22 and the contacts 13 of the header connector 10. Understandably, the manual withdrawal force applied to the module 20 is substantially not aligned with the resistance force applied to the contacts of the socket connector 22 and those of the header connector 10, so sometimes it is uneasy for an operator to practice.

Therefore, an object of the invention is to provide a latching means in the header connector for reliably retaining the module and its associated socket connector in position with regard to the header connector for preventing any loss or intermittence of signal transmission between the mother board and the module.

Another object of the invention is to provide an ejection means in the header connector for efficiently withdrawing the module and its associated socket connector therefrom for easy operation and force-saving.

Yet, another object of the invention is to provide the ejection means in the header connector, which will not interfere with the components positioned aside in the longitudinal direction of the header connector when such ejection means is in an open manner for releasing the module therefrom.

SUMMARY OF THE INVENTION

According to an aspect of the invention, a header connector includes an insulative housing having a plurality of contacts extending upwardly therethrough. The housing is generally formed by a first pair of opposite side walls and a second pair of opposite end walls to define a space therein for receiving a module and its associated socket connector. A pair of cavities are disposed adjacent to two opposite ends of the housing for respectively receiving a pair of corresponding latch/eject members therein wherein each cavity includes a cross-shaped cross-section and extends through in a lateral direction the corresponding surfaces of the housing which define such cavity. Thus, the latch/eject member within the cavity is adapted to be in the housing pivotally retained along an axis which extends in the lengthwise direction of the housing whereby such latch/eject member may lock the module when the latch/eject member is in a first (vertical) locking position, and may project out of the corresponding cavity in the lateral direction for release and ejection of the module when the latch/eject member is in a second (angular) open position.

BRIEF DESCRIPTION OF THE DRAWINGS

FIG. 3(A) is an exploded perspective view of the header connector of FIG. 1 with an end portion being cut-away to show the inner cavity.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 2:
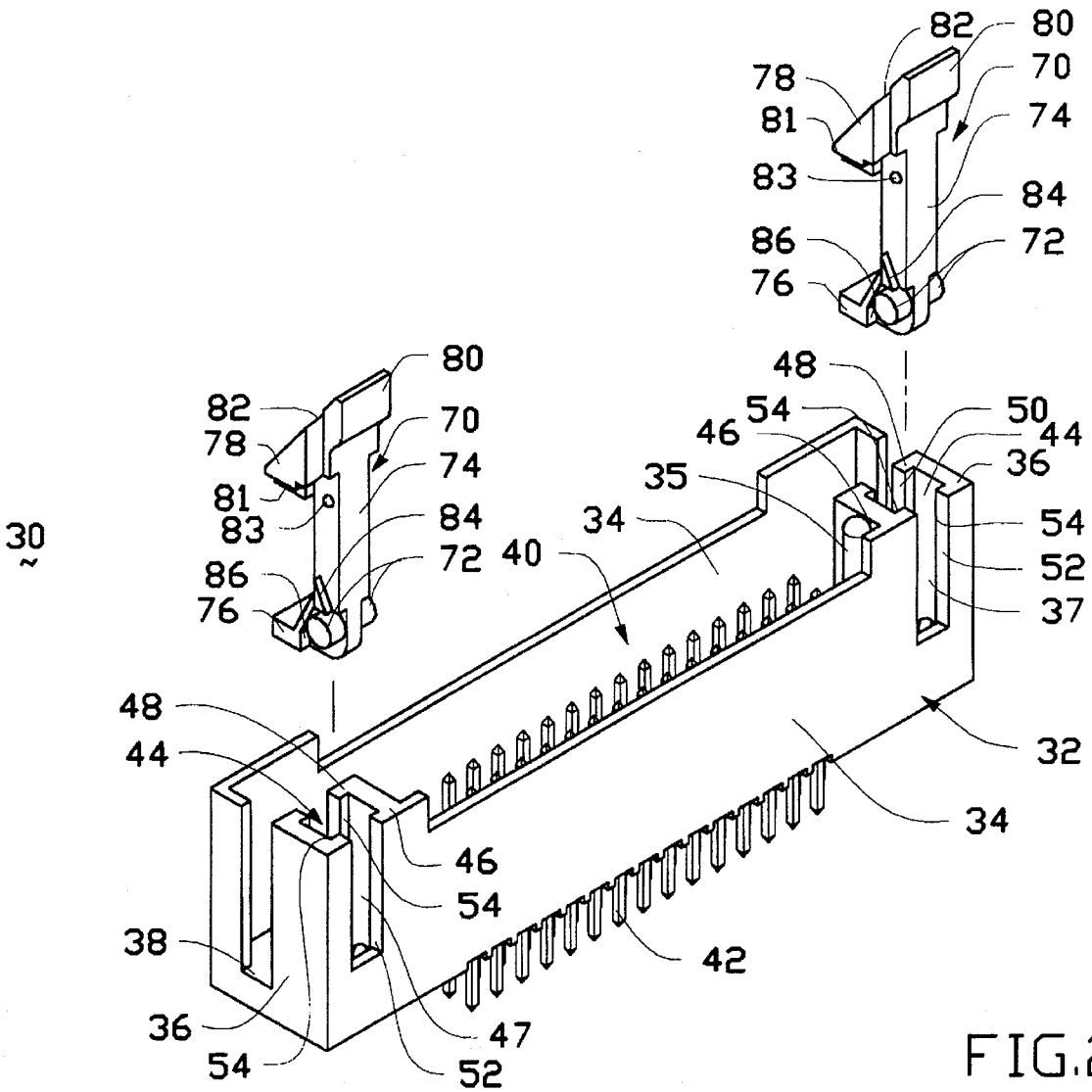
FIG. 2 is an exploded perspective view of a header connector of a presently preferred embodiment according to the invention.
Figure 3:
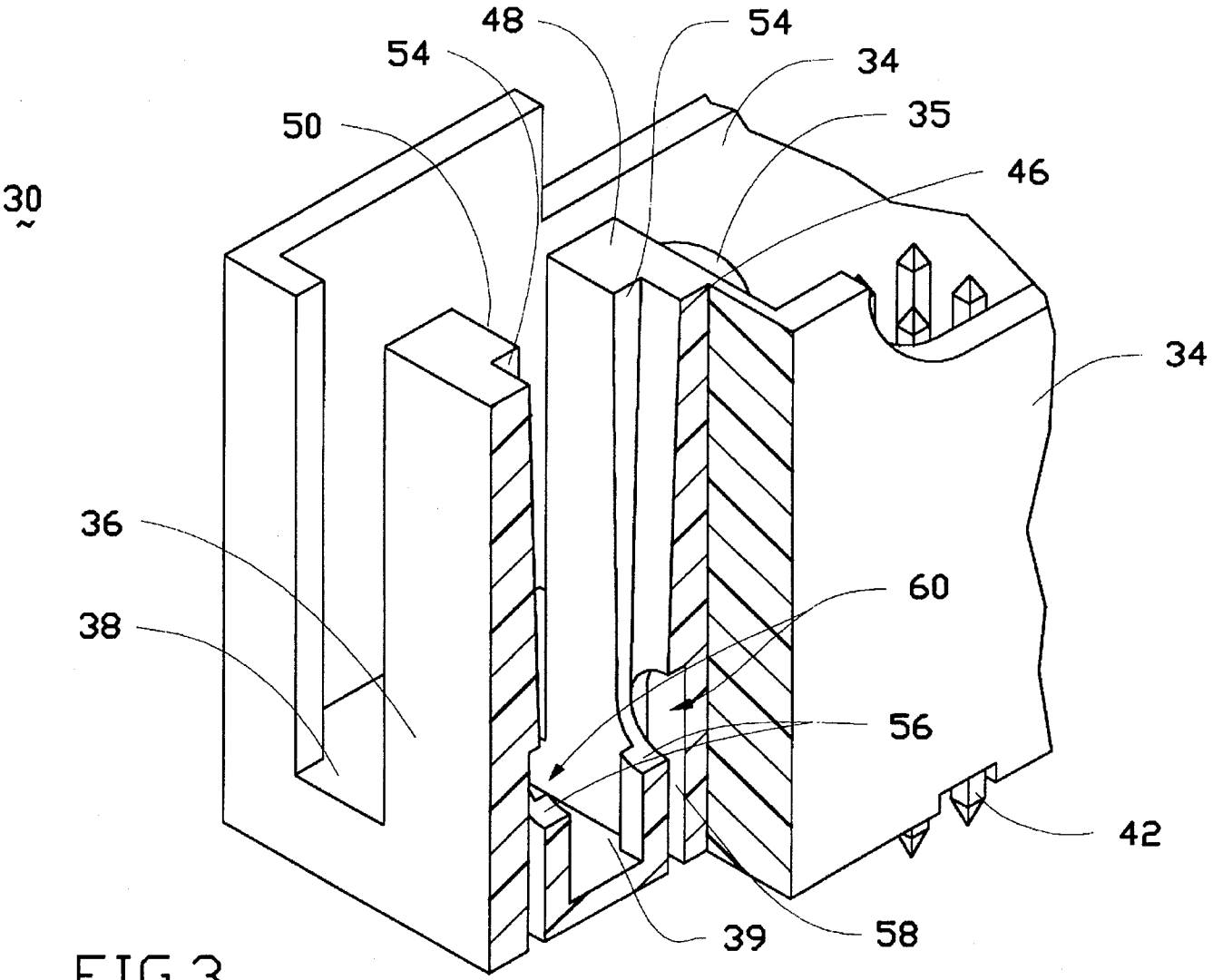
FIG. 3 is a fragmentary cut-away perspective view of the header connector of FIG. 2 to show the interior structure for pivotal retaining the latch therein.
Figure 3:
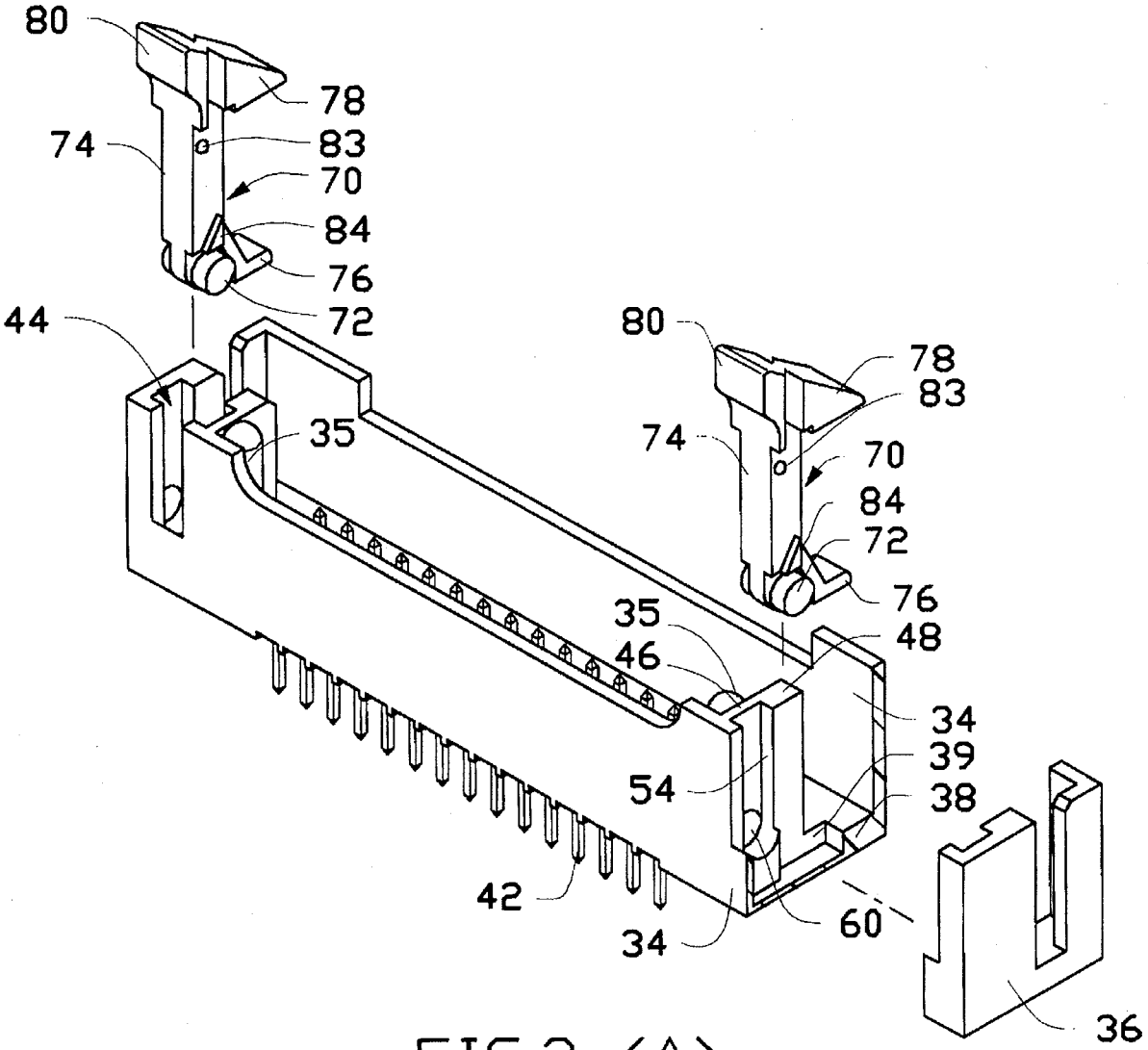
Figure 5:
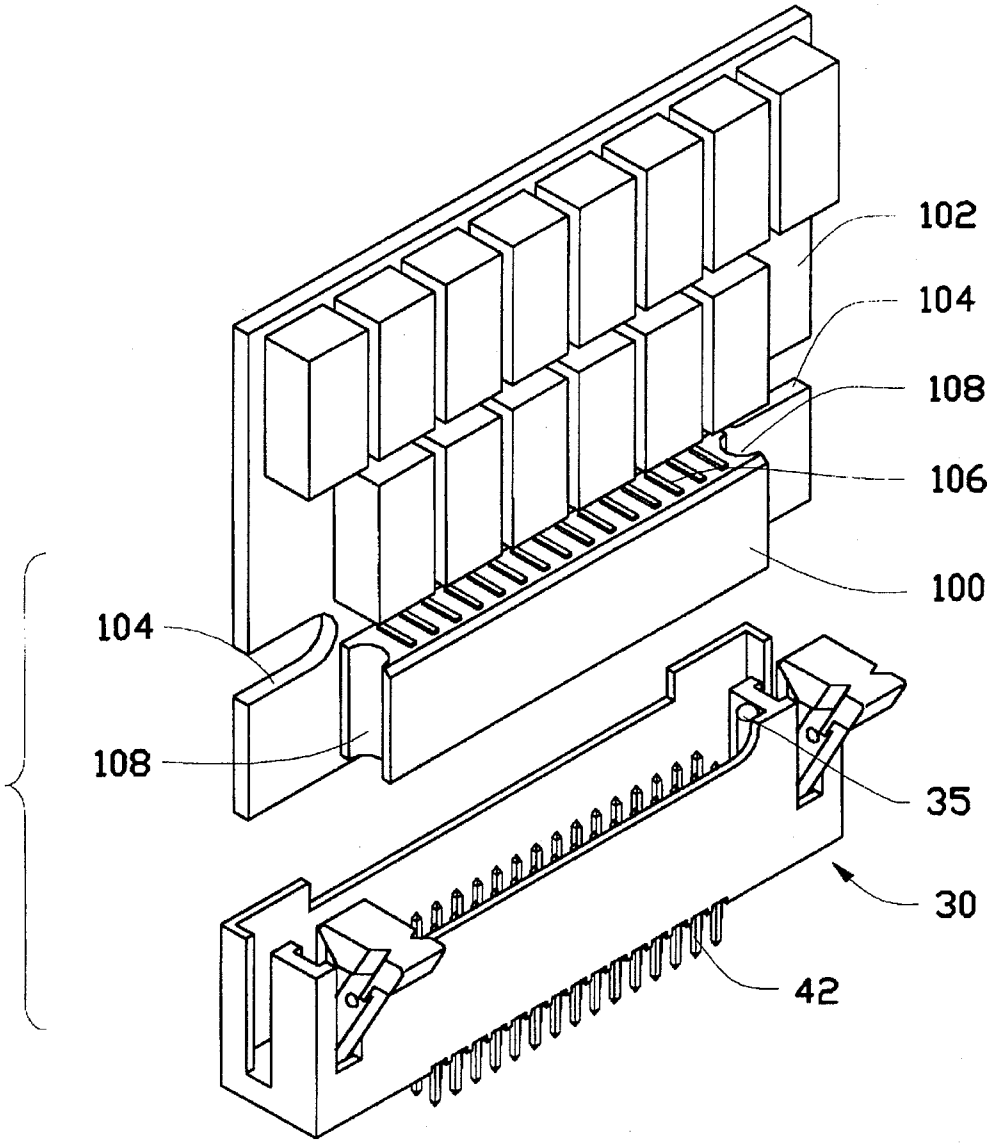
FIG. 5 is a perspective view of the header connector of FIG. 2 and a module, with its associated socket connector, adapted to be inserted therein.
Figure 6:
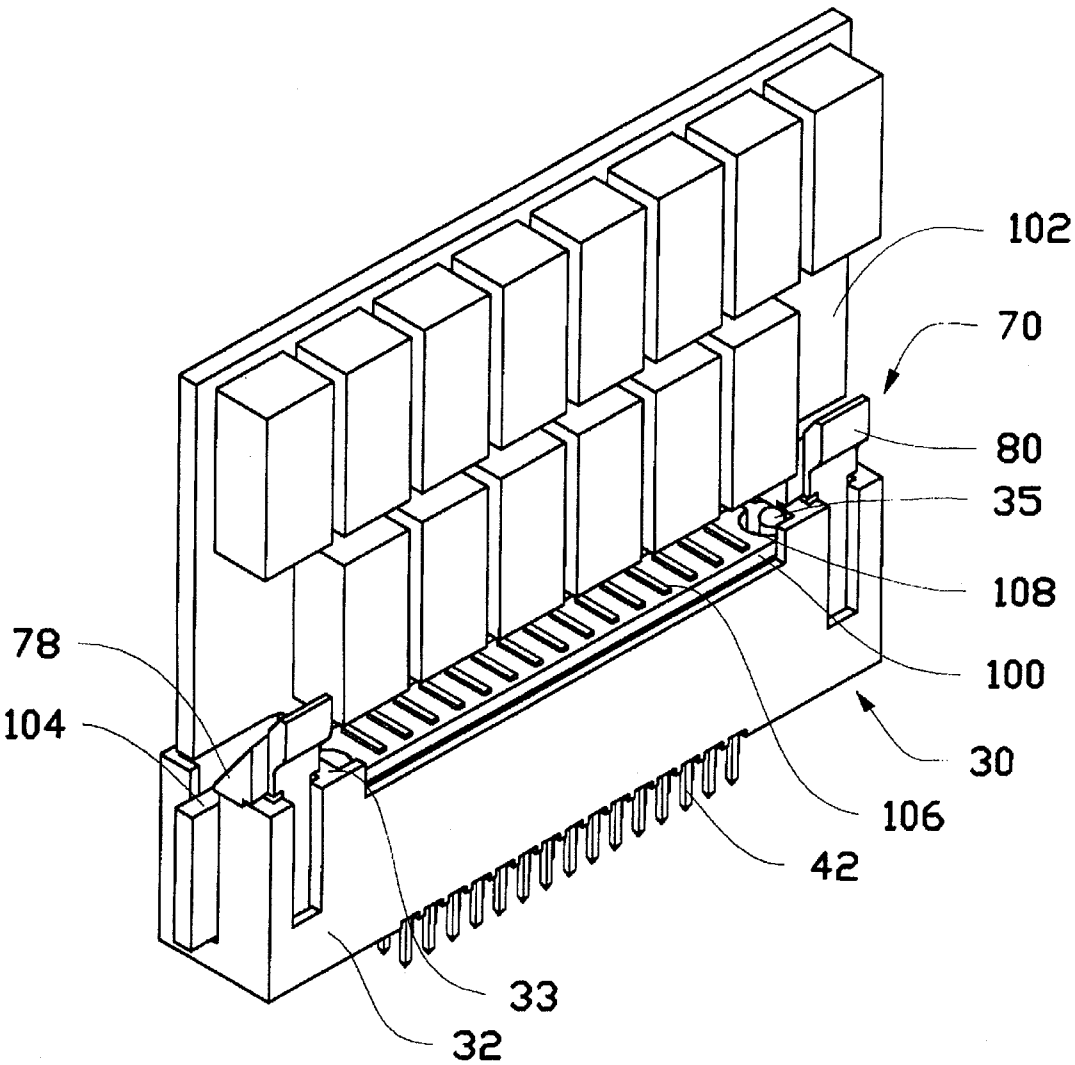
FIG. 6 is a perspective view of the header connector and the module of FIG. 5 in a locked state.

It will be noted here that for a better understanding, most of like components are designated by like reference numerals throughout the various figures in the embodiments. Attention is now directed to FIGS. 2, 3 and 3(A) wherein a header connector 30 includes an elongated insulative housing 32 comprising a pair of side walls 34, a pair of end walls 36, and a bottom plate 38, thus forming a upward space 40 for receipt of a complementary socket connector 100 and its associated module 102 therein (FIG. 5).

A plurality of contacts 42 vertically extend through the space 40 and the bottom plate 38 for communication with the socket connector 100 and a mother board (not shown) on which the header connector 30 is seated. A cavity 44 positioned adjacent to either end of the housing 32, is generally defined by the end wall 36, the adjacent side wall 34, a retention wall 46 which is opposite to the corresponding end wall 36, and a restriction wall 48 which is parallel to the side wall 34. A first lengthwise passageway 50 generally extends laterally through the restriction wall 48, and oppositely a second lengthwise passageway 52 extends laterally through the side wall 32, thus allowing a latch/eject member 70 to pivotally move in the cavity 44 of the housing 32, in the lateral direction with regard to the housing 32, without interference.

Oppositely, a pair of shallow channels 54 are recessed from the inner surface 37 of the end wall 36 and the inner surface 47 of the retention wall 46, respectively, in the lengthwise direction for passage of insertion of latch/eject member 70. Accordingly, the cavity 44 has a cross-like cross-sectional configuration due to the first passageway 50, the opposite second passageway 52, and the pair of opposite shallow channels 54 thereof. This feature allows vertically loading the latch/eject member 70 into the housing 32 and will be described in detail later.

Referring to FIGS. 3 and 3(A), an expanded semi-circular support 56 is located at the bottom end of each shallow channel 54. Correspondingly and oppositely, another channel 58 extends from the bottom surface of the housing 32 upward closely adjacent to the corresponding shallow channel 54 wherein the top end of the channel 58 is also of the semi-circular configuration, so that the rounded bottom end of the downward extending channel 54 (including the support 56) incorporatively overlaps the rounded top end of the upward extending channel 58 to form a through hole 60 which is adapted to retainably receive a spindle 72 of the latch/eject member 70 therein.

Referring to FIGS. 3, 3(A), 8 and 9, a recess 39 is formed in the bottom plate 38 for receipt of a ejection toe 76 of the latch/eject member 70 therein, so that there will be no improper interference between the latch/eject member 70 and the bottom edge of the inserted module 102 when the module 102 is fully latched by the latch/eject member 70 and is embedded within the header connector 30.

Generally referring to FIG. 2 and 3(A), the latch/eject members 70 are designedly received within the pair of cavities 44 in the housing 32, respectively. Each latch/eject member 70 includes a main body 74 having an ejection toe 76 horizontally extending at the bottom end and a latching hook 78 horizontally extending at the top end. A lever 80 extends upward and obliquely opposite to the latching hook 78 at the top end of the main body 74. A finger grip surface 82 integrally formed with the hook 78 and the lever 80, is directed upward in a predetermined angle which will be illustrated in detail later. In comparison with the main body 74, the latching hook 78 and the lever 80 including the surface 82 thereof, substantially have a larger width than the main body for easy and reliable manual operation of the latch/eject member 70. A pair of spindles 72 are respectively positioned approximate the bottom end of two sides of the main body 74. On each side surface of the main body, an auxiliary stopper 84 is formed adjacent to the spindle 72 for limiting the angle of rotation of the latch/eject member 70 in the cavity 44, and a dimple 83 is disposed above the stopper 84 for helping secure latch/eject member 70 within the cavity 44 when such latch/eject member 70 is in a closed state. A offset 86 is positioned around the spindle 72 not to interfere with the expanded support 56 of the housing 32.

Figure 4:
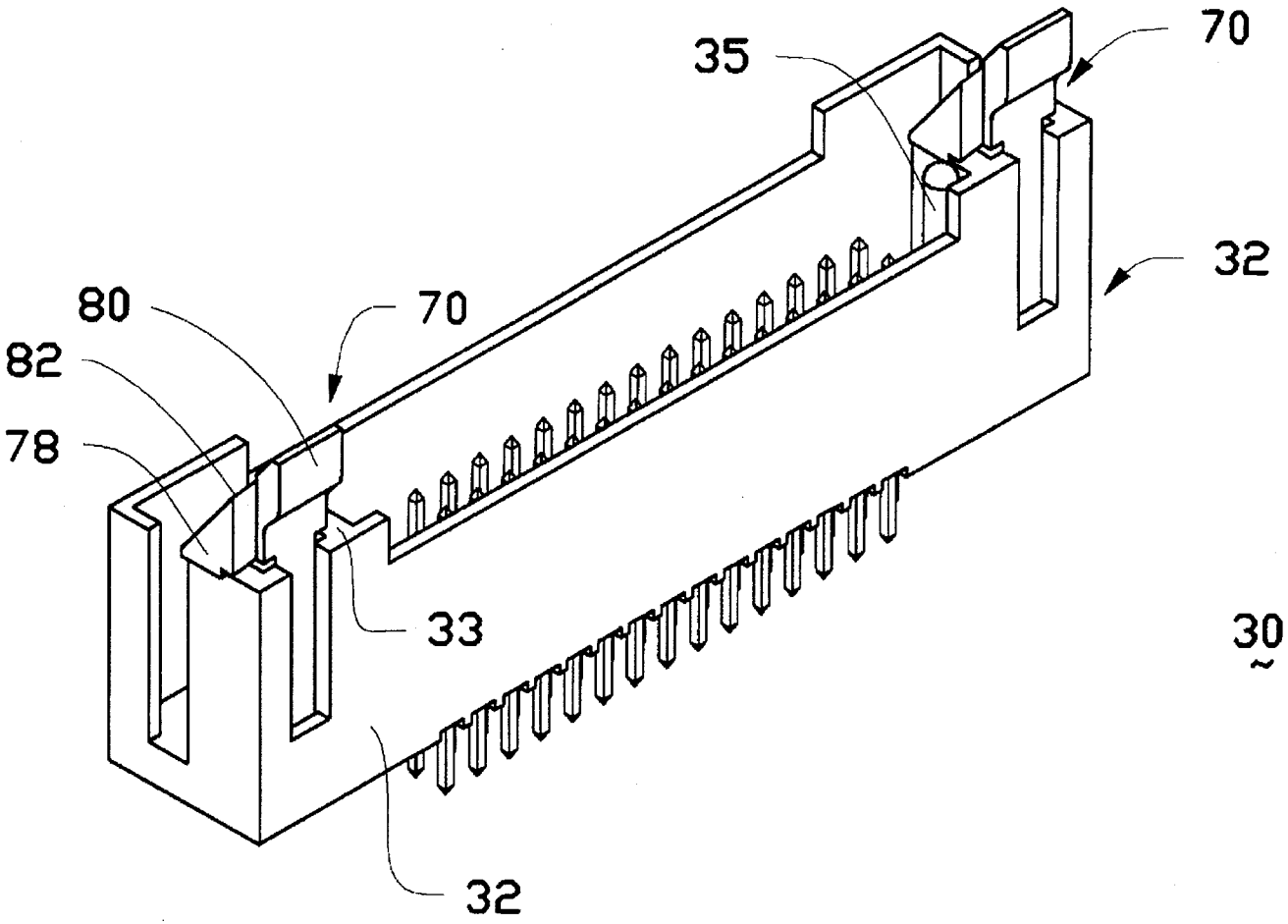
FIG. 4 is a perspective view of the assembled header connector of FIG. 2.

When assembled, the latch/eject members 70 are respectively loaded into the corresponding cavities 44 from the top of the housing 32 in a press fit. Two spindles 72 positioned on two sides of the main body 74 of the latch/ejector member 70 move downward along the corresponding shallow channels 54 in the housing 32 wherein the ejection toe 76 of the latch/ejector member 70 directly moves downward along the first passageway 50 from top to bottom, until the spindles 72 abut against the supports 56 and the tips of the spindles 72 are sprung out by resilience and fully enter the corresponding holes 60. The spindle 72 is not allowed to upward move back because of its engagement with the top end of the channel 58. Under this situation, the ejection toe 76 of each latch/ejector member 70 generally override the bottom plate 38 of the housing 32, and the lever 80 and the hook 78 of the latch/eject member 70 including the finger grip surface 82 project out of the top surface 33 of the housing 32 for easy operation, as shown in FIG. 4.

Figure 1:
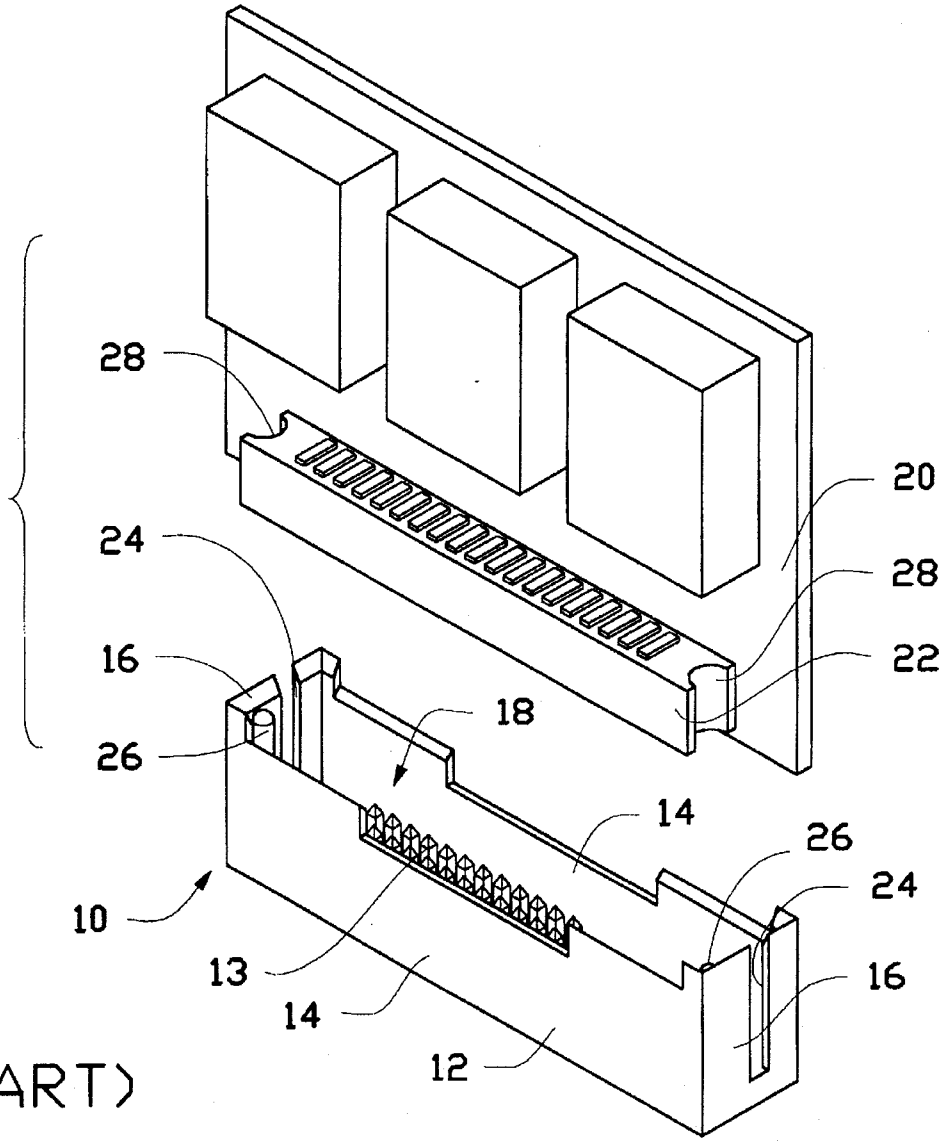
FIG.1 (PRIOR ART)
FIG. 1 is a perspective view of a header connector and a module with its associated socket connector of the prior art.

Referring to FIGS. 5, 6 and 7(A)–7(D), similar to the conventional module 20 with its associated socket connector 10 as shown in FIG. 1, the module 102 and it associated socket connector 100 is intended to be inserted into the header connector 30 in the invention whereby the funnels 108 of the socket connector 100 may move along in alignment with the posts 35 of the header connector 30. Different from that in the prior arts shown in FIG. 1, the header connector 30 of the invention provides a pair of latch/eject members 70 at two opposite ends along its lengthwise direction, so that the module 102 for use with the header connector 30 of the invention is required to include a pair of notches 104 at its two side edges for cooperation with the hooks 78 of the latch/eject members 70 in the housing 32. The latch/eject members 70 are in a angular open position not to have their hooks 78 occupy the space the module takes in the housing 32 and not to obstruct the insertion of the module 102 with its associated socket connector 100 into the header connector 30.

Once the bottom edge of the module 102 engages the ejection toes 76 of the latch/eject members 70, the continuous downward movement of the module 102 actuates each latch/eject member 70 to be rotated about the spindles 72 wherein the hook 78 of the latch/eject member 70 gradually pivotally moves toward the module 102. The downward movement of the module 102 with its associated socket connector 100 continues until the ejection toe 76 of the latch/eject member 70 abuts against the bottom plate 38 of the housing 32. Under this condition, the hook 78 of each latch/eject member 70 is fully engaged within the corresponding notch 104 of the module 102, so that the module 102 is reliably locked by such pair of latch/eject members 70 in the housing 32 of the header connector 30. Understandably, the contacts 106 of socket connector 100 is naturally engaged with the contacts 42 of the header connector 30, thus resulting in signal transmission between the mother board and the module 102. It is noted that when the latch/eject member 70 is such a closed manner, the dimples 83 may butt the end wall 36 for preventing the latch/eject member 70 from inadvertent rotational movement in the cavity 44 due to unexpected vibration or impact, thus assuring reliable data communication thereof.

The successive steps of insertion of the module 104 into the housing 32 of the header connector 30 may be referred to FIGS. 7(A)–7(D) in a reverse order. It is noted that in the fixed (vertical) position, the lever 80 only projects out of the housing in the vertical direction for easy manual access but does not exceed the housing 32 in the lateral direction for maintaining a compact contour of the whole header connector.

When the module 102 and the associated socket connector 100 is intended to be withdrawn from the header connector 30, the latch/eject member 70 may be rotated in reverse by applying manual force to the lever 80 on the finger grip surface 82. This reverse rotation of the latch/eject member 70 may overcome the interference between the dimples 83 of the latch/eject member 70 and the side wall 34 of the housing 32, and also is superior to the engagement between the contacts 106 of the socket connector 100 and those of the header connector 30. This reverse rotation of the latch/eject member 70 designedly releases the module 102 by means of the hook 78 of the latch/eject member 70 leaving the notch 104 of the module 102. Therefore, the reverse rotation of the latch/eject member 70 actuates the ejection toe 76 of the latch/eject member 70 to move upward, thus pushing the module 102 and its associated socket connector 100 upward out of the header connector 30. This upward movement of the module 102 may stop when the latch/eject member 70 is rotated to an final angular open position where the main body 74 of the latch/eject member 70 substantially engages the end wall 34 of the housing 32. The processes of removal of the module 102 from the header connector 30 may be successively referred to FIGS. 7(A)–7(D).

It can be appreciated that in comparison with the prior arts, the invention provides not only a reliable retention for the inserted module 102, but also an easy, force-saving lever application for withdrawing the inserted module 102 from the header connector 30. It is noted that in the invention, the latch/eject members 70 releasably latch the module 102, by means of the hooks 78 of the latch/eject members 70 being in engagement within the corresponding notches in the module 102, in a lateral direction with regard to housing 32. In other words, the latch/eject member 70 movably faces normally to and locks the module 102, and that is different from some other prior arts as shown in U.S. Pat. No. 5,364,282 wherein the latch/eject member is positioned by two opposite lengthwise ends of the module and movably rotates in the lengthwise direction of the module. It is also understood that in the present invention, the latch/eject performance is applied to the module 102 itself, not to the associated socket connector 100. It is noted that if such latch/eject functions are applied to the socket connector 100, the dimension of the standard socket connector may be required to increase for compliance with the corresponding portions of the hook 78 and the ejection toe 76 of the latch/eject member 70, thus preventing using the existing industry standard socket connector 100 which is of a lower price, and that is undesired for the computer manufacturer.

Figure 8:
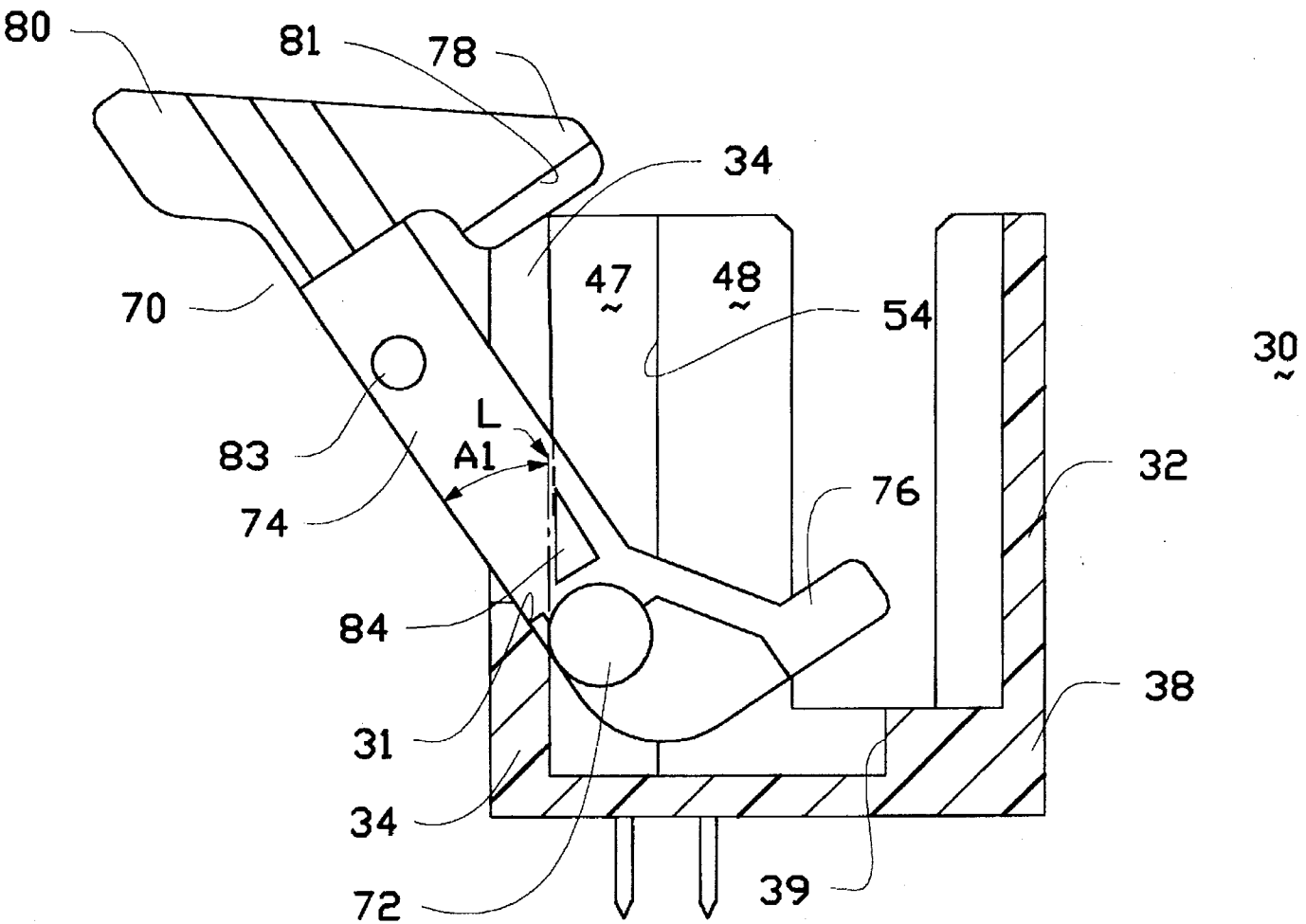
FIG. 8 is a cross-sectional view of the header connector of FIG. 4 without contacts therein to show the latch/eject member is therein received in an open state.
Figure 9:
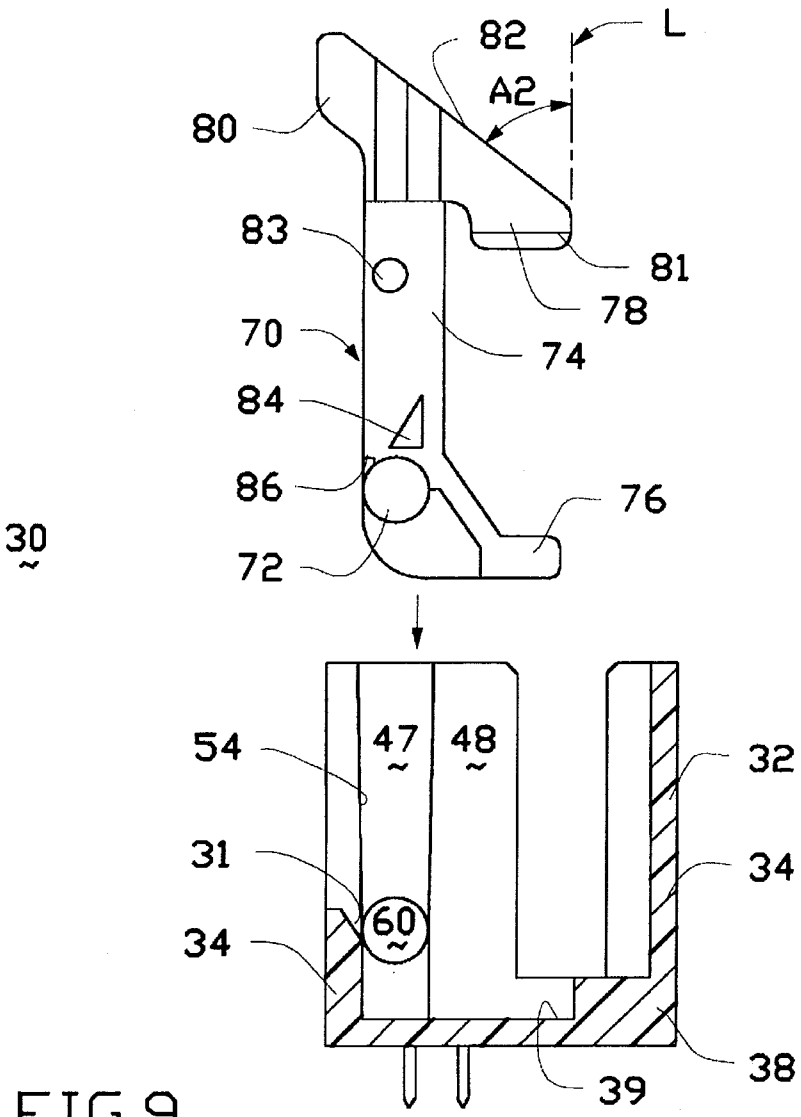
FIG. 9 is a cross-sectional view of the header connector of FIG. 2 to show vertical installation of the latch/eject member thereto.

Referring to FIGS. 8 and 9, a slanted engagement surface 31 is form on the top edge of the side wall 34 so that the main body 74 of the latch/eject member 70 may be stably seated thereon whereby the latch/eject member 70 may stop at its final angular open position. To assist this rotation stop of the latch/eject member 70, the auxiliary stoppers 84 may abut against the inner surface of the end wall 34, so that the latch/eject member 70 will not be inadvertent over-rotation that may hit and jeopardize the components mounted on the mother board adjacent to the header connector 30. It is also noted in this embodiment that to an imaginary vertical line L, the included angle A1 (FIG. 8) formed by engagement surface 31 plus the included angle A2 (FIG. 9) formed by the finger grip surface 82, when the latch/eject member 70 is in a vertical position, may be equal to a right angle, thus assuring the finger grip surface 82 may be located in a horizontal plane, in its final open position, which prevents the fingers from inadvertently sliding down therefrom during manual operation on the lever 80. It can be contemplated that if such surface 82 is not in a horizontal plane or is substantially moved to a outwardly slanted angle when the latch/eject member 70 is in its final angular open position, it is easy for the fingers to slide along such surface 82 and touch the components aside. This may result in damage of such adjacent components or hurt of fingers.

Figure 7B:
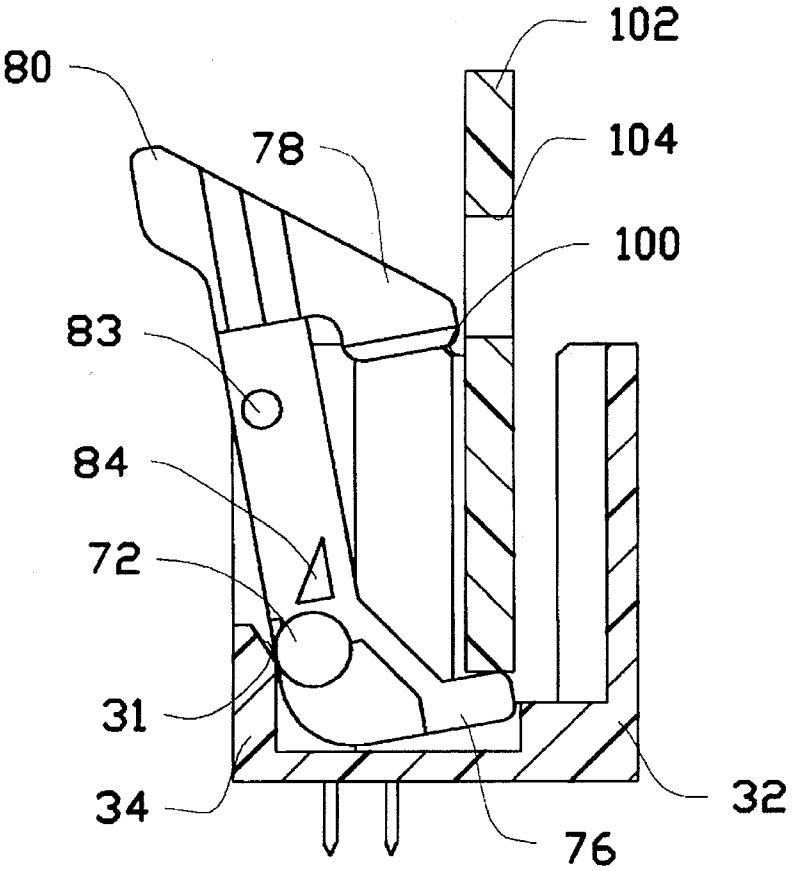
FIG. 7(B) is a cross-sectional view of the header connector and the module of FIG. 5 close to being in a partially locked state.
Figure 7A:
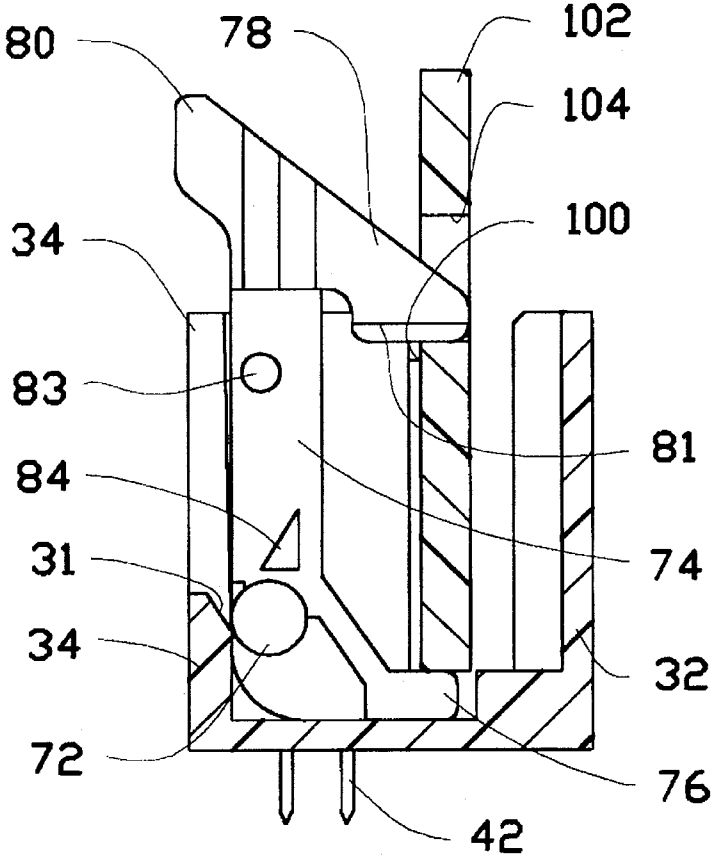
FIG. 7(A) is a cross-sectional view of the header connector and the module of FIG. 5 in a completely locked state.
Figure 7D:
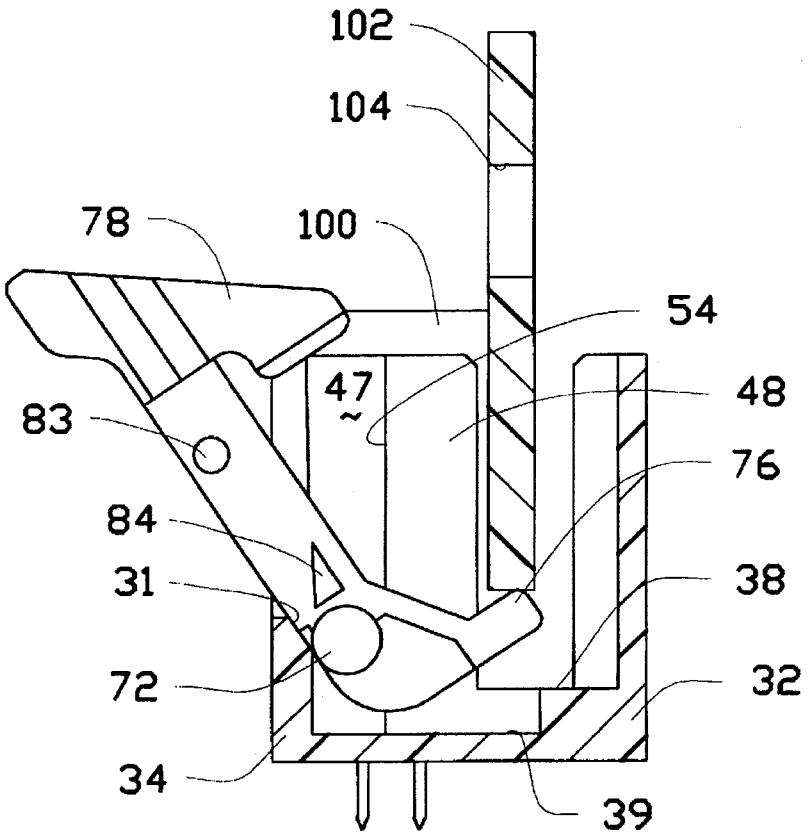
FIG. 7(D) a cross-sectional view of the header connector and the module of FIG. 5 in a final unlocked or open state.
Figure 7C:
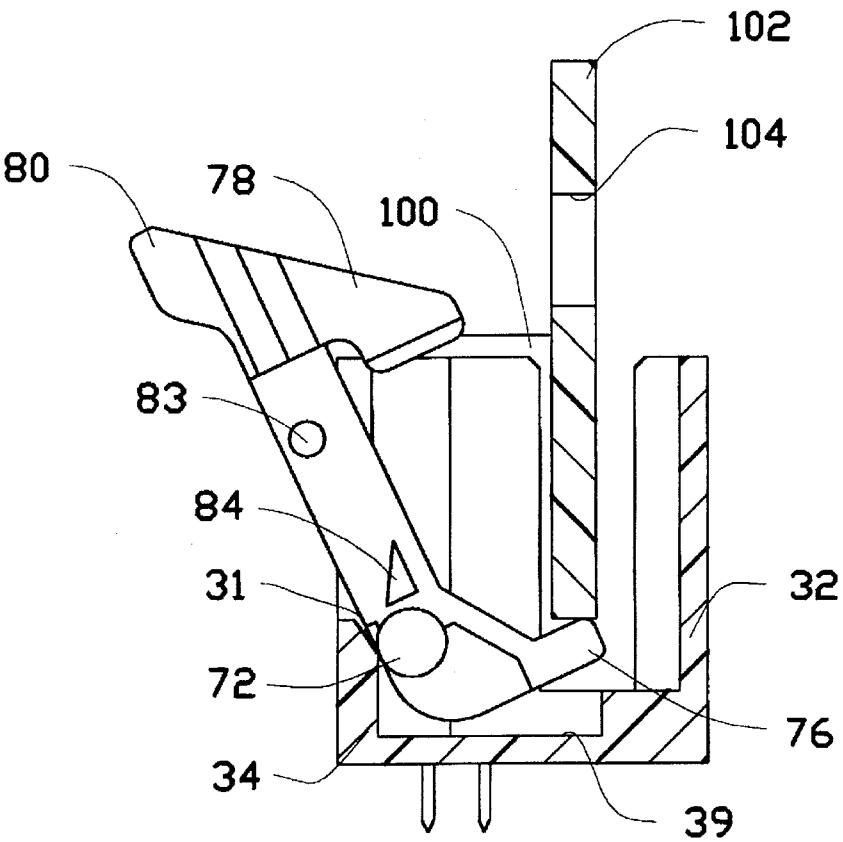
FIG. 7(C) is a cross-sectional view of the header connector and the module of FIG. 5 in an unlocked state.

Referring to FIG. 9, the latch/eject member 70 is loaded into the cavity 44 vertically from the top, thus making it easier for manufacturing (assembling). This results from the cross-sectional configuration along the latch/eject member 70 conformable to the cross-like cross-section of the cavity 44 in the housing 32. It is also noted that an indent 81 is positioned on either side under the hook 78 for avoiding interfering with the restriction wall 48 when the latch/eject member is in a fixed position as shown in FIG. 7(A).

Figure 10A:
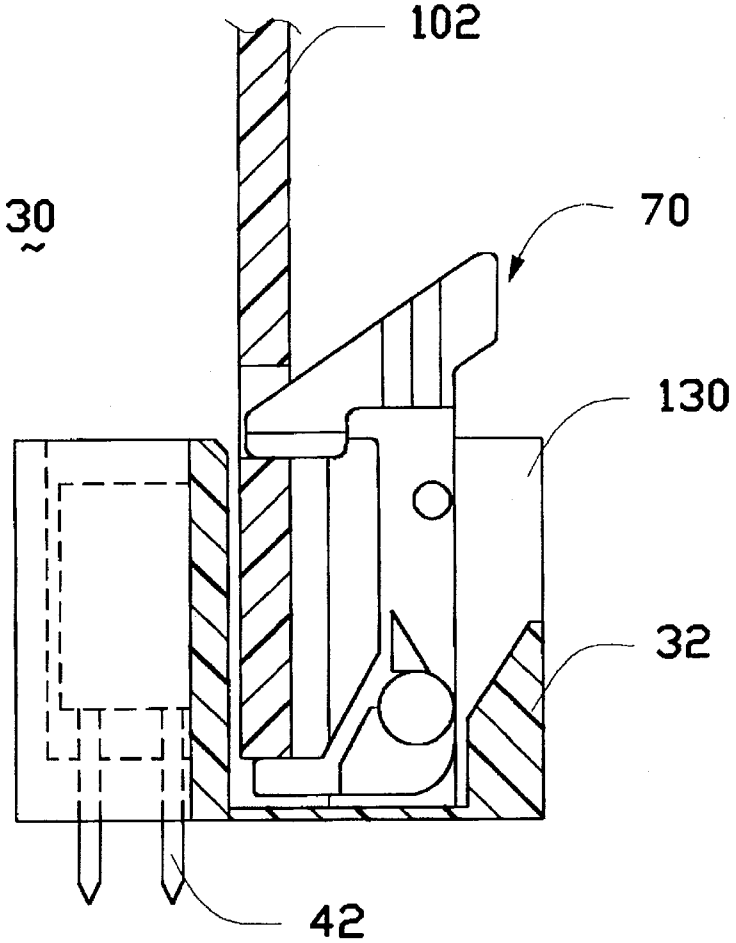
FIG. 10(A) is a cross-sectional view of a header connector of FIG. 10 having a module locked therein.
Figure 10:
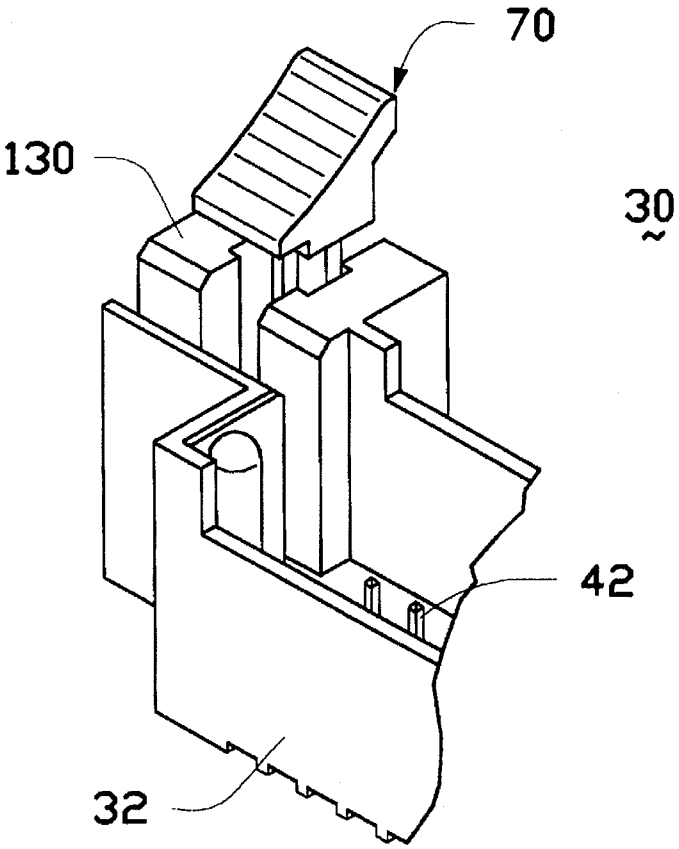
FIG. 10 is a partially perspective view of a header connector of another embodiment according to the invention wherein the latch/eject member is located on the other side of the header connector.

FIGS. 10 and 10(A) shows another embodiment of the invention wherein the housing 32 has an expansion portions 130 at two opposite ends in a lateral direction for receiving therein a pair of latch/eject members 70 wherein different from the first embodiment which discloses the latch/eject member 70 and the contacts 42 at the same side with regard to the inserted module 102, this (second) embodiment has the latch/eject member 70 and the contacts 42 positioned at the opposite sides with regard to the inserted module. This difference only results from different applications, and does not influence the aspects or features based on the spirit of the invention.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A header connector for use with a module having an associated socket connector wherein said module has a pair of notches at two side edges, said header connector comprising:

an elongated insulative housing defining a lengthwise direction along said housing and a lateral direction, said housing comprising a pair of side walls, a pair of end walls and a bottom plate;

a plurality of contacts vertically extending in the housing;

a pair of cavities formed at two opposite ends of the housing for receiving a pair of corresponding latch/eject members therein; and each of said cavities being formed by one of said end walls and an opposite retention wall in said lengthwise direction, and by one of said side walls and an opposite restriction wall in said lateral direction, wherein a first passageway is formed in the restriction wall, a second passageway is formed in the corresponding opposite side wall, and a pair of opposite shallow channels are formed in the retention wall and the corresponding opposite end wall, thus defining a cross-like cross-sectional configuration of said cavity for allowing vertically loading the latch/eject member therein, said latch/eject member being rotated about a rotation axis defined in said lengthwise direction and rotated in a plane which is generally perpendicular to said lengthwise direction, whereby the first passageway in the restriction wall and the second passageway in the side wall allows a lateral rotation of said latch/eject member with regard to the housing, and said latch/eject member is latchably engaged within the corresponding notch in the module in a normal direction with regard to said module.

2. The header connector as defined in claim 1, wherein each of said latch/eject member includes a main body having a ejection toe at approximate a bottom end and a hook and lever at approximate a top end.

3. The header connector as defined in claim 2, wherein said hook and said lever both defining a finger grip surface which incorporates a slanted engagement surface on the end wall for providing said finger grip surface with a horizontal position for safe operation when said latch/eject member is in a slanted final open position.

4. The header connector as defined in claim 3, wherein to an imaginary vertical line, a first included angle defined by the engagement surface on the end wall plus a second included angle defined by the finger grip surface on the latch/eject member when said latch/eject member is in a vertical position, is close to a right angle.

5. The header connector as defined in claim 2, wherein said housing includes a recess in the bottom plate corresponding to each cavity for receiving the ejection toe of the latch/eject member when said latch/eject member is in a vertical fixed position.

6. The header connector as defined in claim 2, wherein said rotation axis is defined by a pair of spindles positioned on two sides of the main body of the latch/eject member.

7. The header connector as defined in claim 6, wherein said shallow channel extends downward from a top surface of the housing and has a rounded end which incorporates another round end of another channel which extends upward from a bottom surface of the housing and close to said shallow channel, to form a through hole for receive the corresponding spindle therein.

8. The header connector as defined in claim 2, wherein a pair of indents are formed under the hook and lever of the latch/eject member for not interference with the restriction wall.

9. A header connector for use with a module which has an associated socket connector positioned at one side of the bottom edge portion of said module wherein said module includes at least a notch at one side edge, said header connector comprising:

an elongated insulative housing generally having a space defined by a pair of opposite side walls, a pair of opposite end walls and a bottom plate;

said housing substantially defining a first direction along a lengthwise direction of said housing, and a second direction normal to said first direction;

at least one cavity positioned at one lengthwise end of said housing; and at least one latch/eject member received within said one cavity, said latch/eject member including a main body and an ejection toe at a bottom end and a hook at a top end wherein said latch/eject member is rotatably received in said cavity in the second direction but the module is inserted into the space of the header connector in the first direction so that the hook and the ejection toe are both normal to the module and extend along the second direction, whereby said hook of the latch/eject member may normally access or leave the module during rotation of said latch/eject member about an axis along the first direction, and substantially normally latchably engaged within the corresponding notch in the module when said latch/eject member is in a fixed vertical position.

10. The header connector as defined in claim 9, wherein said housing further includes a retention wall opposite to the end wall for defining said cavity whereby a pair of opposite shallow channels are formed for easy vertical loading from the top said latch/eject member having a pair of spindles at two sides of the main body to define said axis for rotation.

11. The header connector as defined in claim 9, wherein said housing further includes a restriction wall opposite to the corresponding side wall for defining said cavity whereby a first passageway extends along the restriction wall and a second passageway extends along the side wall oppositely for allowing rotation of said latch/eject member in the second direction.

12. The header connector as defined in claim 9 wherein said latch/eject member includes a finger grip surface at the top incorporating an engagement surface on the end wall for providing a horizontal action plane for operation when said latch/eject member is rotated to the slanted final open position.

13. A combination of an electrical assembly comprising:

a header connector having an elongated insulative housing having a plurality of contacts extending upward therethrough;

said housing at least comprising a pair of end walls in a first direction and a pair of side walls in a second direction to define a space;

at least one latch/eject member positioned approximate one end of said housing in the first direction, said latch/eject member at least including an ejection toe at a bottom end and a hook at a top end, a rotation axis being defined adjacent said ejection toe and extending along said first direction so that the latch/eject member being adapted to rotate in the second direction;

a module having at least one notch proximate one edge portion; and a socket connector attached on a bottom edge portion of said module whereby the module accompanying the socket connector is loaded into the space of the header connector from the top wherein the socket connector couples to the header connector, and the module is releasably latched by the hook of latch/eject member in the second direction.

14. The combination as defined in claim 13, wherein said housing further includes a retention wall opposite to the corresponding end wall, and a restriction wall opposite to the corresponding side wall for commonly forming a cavity for receiving said latch/eject member therein.

15. The combination as defined in claim 14, wherein a pair of opposite shallow channels are respectively formed in the retention wall and the corresponding opposite end wall, a first passageway is formed in the restriction wall and a second passageway is formed in the corresponding side wall, so that a cross-like cross-sectional configuration of said cavity is defined for allowing vertically loading said latch/eject member thereto and rotation of said latch/eject member in the second direction.

* * * * *